United States Patent [19]

Leever et al.

[11] Patent Number: 4,600,609

[45] Date of Patent: Jul. 15, 1986

[54] METHOD AND COMPOSITION FOR ELECTROLESS NICKEL DEPOSITION

[75] Inventors: Harold Leever, Bethlehem; Leo J. Slominski, Bristol, both of Conn.

[73] Assignee: MacDermid, Incorporated, Waterbury, Conn.

[21] Appl. No.: 730,763

[22] Filed: May 3, 1985

[51] Int. Cl.[4] ..... C23C 3/02

[52] U.S. Cl. ..... 427/438; 106/1.22; 106/1.26; 427/443.1; 428/936

[58] Field of Search ..... 106/1.22, 1.26; 427/438, 443.1; 428/936

[56] References Cited

U.S. PATENT DOCUMENTS

| | | | |
|---|---|---|---|
| 2,658,841 | 11/1953 | Gutzeit et al. | 427/438 |
| 2,658,842 | 11/1953 | Gutzeit et al. | 427/438 |
| 3,457,089 | 7/1969 | Shipley et al. | 106/1.26 |
| 3,661,597 | 5/1972 | Gucca | 106/1.26 |
| 4,049,509 | 9/1977 | Such et al. | 204/49 |
| 4,265,943 | 5/1981 | Goldstein et al. | 427/443.1 |
| 4,371,397 | 2/1983 | Homna et al. | 106/1.23 |

OTHER PUBLICATIONS

Plokhov et al., *Effect of Leveling Additives in Electroless Nickel Plating.*

*Primary Examiner*—Lorenzo B. Hayes

*Attorney, Agent, or Firm*—St. Onge Steward Johnston & Reens

[57] ABSTRACT

An electroless nickel plating method and composition is disclosed wherein a soluble acetylenic compound is included within the plating bath in small amounts effective to improve the specularity of the nickel deposit without substantially decreasing the electroless plating rate of the bath. The method and compositions of the invention are useful in producing mirror-bright electroless nickel coatings free of haze.

29 Claims, No Drawings

METHOD AND COMPOSITION FOR ELECTROLESS NICKEL DEPOSITION

BACKGROUND OF THE INVENTION

The present invention relates to the electroless depositing of nickel coatings onto substrate surfaces and, more particularly, to a method and composition for use in obtaining bright nickel deposits on substrate surfaces by means of electroless depositing.

The electroless deposition of metals such as nickel or copper or alloys thereof onto the surfaces of both conductive (metal) or non-conductive substrates has been known and practiced for some time now. The most commonly practiced method of electroless deposition involves chemical reduction, i.e., wherein deposition takes place by the action of a reducing agent on dissolved metal in the presence of a substrate composed of an inherently catalytic material or a substance catalyzed by some form of pretreatment.

The essential principles of electroless deposition of nickel or nickel alloys are described in a number of patents and publications. Illustrative references include U.S. Pat. Nos. 2,532,283; 2,658,839; 2,658,841 and 2,658,842 and a 1954 review or Brenner, entitled "Electroless Plating Comes Of Age", Metal Finishing, December 1954, pp. 61 through 76, all of which are expressly incorporated herein by reference. Essentially, the bath or solution employed in electroless nickel depositing includes a soluble source of nickel ions, a reducing agent such as a hypophosphite compound, a complexing agent to prevent precipitation of metal ions from solution aand an acid or alkaline pH adjusting compound (including optional buffering compounds).

Electroless nickel bath or solutions of this type result in the depositing of a dull nickel coating on the substrate surfaces. Proposals have been maade for the inclusion in the plating solution of small amounts of metals such as lead, bismuth, antimony, molybdenum and the like to provide a brighter nickel deposit. Solutions such as these, when used to plate substrates such as rolled or cast steel, aluminum and the like, produce a nickel coating which is grainy and which may appear lustrous. However, for decorative applications on a buffed surface, the nickel deposit generally appears hazy or cloudy rather than specular as a mirror.

SUMMARY OF THE INVENTION

It is an object of the present invention to provide a method and composition for enabling the deposit of lustrous, specular nickel coatings on substrate surfaces by means of electroless depositing techniques.

Another object of the present invention is to attain lustrous, specular nickel coatings on substrate surfaces by means of electroless depositing techniques in a manner which does not substantially adversely affect the depositing characteristics of the plating solution, particularly its rate of deposition.

These and other objects which will become apparent from the description which follows are achieved by the inclusion in an electroless nickel depositing solution of a small but effective amount of a soluble acetylenic compound, that is, a compound containing a carbon-carbon triple bond.

According to the present invention, an electroless plating composition is provided which comprises a soluble source of nickel ions, a reducing agent, a complexing agent, an appropriate pH adjusting or maintenance agent or agents, and a small quantity of a soluble acetylenic compound sufficient to produce a bright, and preferably lustrous and mirror-like, nickel coating on a substrate surface when said substrate is contacted with said plating solution under conditions at which electroless deposition of nickel occurs.

The present invention also comprises a method for depositing bright, and preferably mirror-like, lustrous, nickel coatings on substrate surfaces by contacting said substrate, under conditions effective for electroless deposition, with the plating composition above described.

The composition and method of the present invention are particularly applicable to the provision of specular nickel coatings on surfaces of metal substrates but also may be employed for coating non-metallic substrates which have been suitably prepared and catalyzed to initiate the deposition and accept the coating. The electroless plating composition itself is autocatalytic, i.e., the coating deposited therefrom itself catalyzes further deposition irrespective of the nature of the substrate per se.

A very significant advantage of the present invention is that the acetylenic compound employed to attain bright miror-like nickel deposits is effective for such purpose without substantially adversely affecting (i.e., slowing) the rate of electroless deposition from the solution. As will be apparent from the discussion of prior art which follows, this was a most surprising and unexpected result. In addition, the acetylenic compounds contribute non-foaming and/or foam-controlling properties to the plating solution.

DISCUSSION OF PRIOR ART

Acetylenic compounds are not entirely new to the general field of electrolytic plating or electroless plating.

In U.S. Pat. No. 2,970,951, there is described an electrolytic process for depositing copper onto substrate surfaces which employs an aqueous alkaline copper-cyanide plating bath containing specified acetylenic ether nitriles as the sole brightening agent, or in combination with tellurium, to provide bright copper deposits. In U.S. Pat. No. 2,881,122, en electrolytic process for producing bright copper deposits employs a copper-cyanide plating bath containing a combination of alkali-soluble tellurium compounds and water-soluble acetylenic compounds. Acetylenic alcohols and acetylenic amines are disclosed as preferred.

Acetylenic compounds also have been employed in electrolytic nickel processes. U.S. Pat. No. 2,978,391 discloses a process for electrolytic deposition of nickel on substrates employing an aqueous acid nickel plating bath containing two "cooperating addition agents" to aid in producing bright, ductile, smooth deposits. One of the agents is an organic sulfonamide, sulfimide or sulfonate while the other is a sulfur and cyano- or nitrile-group containing compound. One example of the latter is described as B-propargylmercaptopropionitrile. U.S. Pat. No. 3,898,138 discloses a nickel electroplating process using a bath containing three addition agents, one of which is an alkyne diol, to contribute to provision of a fine-grained, lustrous, ductile deposit. In U.S. Pat. No. 4,049,509, bright nickel is electrodeposited from an acid plating bath containing the reaction product of an acetylenic diol and an alkylene oxide as well as some of the unreacted acetylenic diol. U.S. Pat. No. 4,054,495 discloses an aqueous nickel electroplating solution, for producing bright and semi-bright coatings, containing three acetylenic compounds—acetylenic alcohol, mono- and/or di-alkoxylated derivatives of acetylenic alcohols, and N-disubstituted aminopropyne.

Acetylenic compounds also have been disclosed for use in electroless plating, and specifically for electroless copper plating, although it is apparent that the inherent differences between electrolytic and electroless processes are such that equivalent functionality between the two processes of any given additive for any particular purpose cannot be assumed. This appears to be particularly true as to acetylenic compounds. In electrolytic copper processes, as earlier discussed, certain acetylenic compounds are used in aid of producing bright deposits. In certain electroless copper processes, using formaldehyde reducing agents, acetylenic compounds are disclosed only as having a stabilizing effect on the plating solution or as improving ductility (acetylenic surfactant). See, for example, U.S. Pat. Nos. 3,661,597; 3,790,392; and 4,371,397. As to non-formaldehyde electroless copper plating baths, U.S. Pat. No. 4,265,943 discloses butyne diol as an "organic additive" which appears to give added bath stability and pinker, smoother deposits, but at the same time slows the deposition rate of the bath.

Finally, 1977 article of Plokhov, et al. entitled "Effect Of Leveling Additives In Electroless Nickel Plating" (IZU. UYSSH. UCHE. ZAVED., KHIM. KHIM. Tekhnol, 20(a)) disclosed that in a nickel, hypophosphite-reduced electroless bath, being investigated as to leveling and brightening of the deposit, the addition of butyne diol slowed the deposition rate considerably and that addition of 0.05 grams per liter or more of butyne diol stopped the reaction completely.

DETALED DESCRIPTION OF THE INVENTION

The electroless nickel plating compositions of the present invention contain the following ingredients dissolved in a suitable solvent, typically water: (a) a soluble source of nickel ions; (b) a soluble source of a reducing agent for the nickel compound, typically and preferably a soluble source of hypophosphite ion; (c) a complexing agent for nickel ions sufficient to prevent their precipitation from the solution; (d) an acid or alkaline pH adjusting agent, optionally including a buffering agent; and (e) a soluble acetylenic compound.

The soluble source of nickel ions generally will be nickel sulfate because of its ready availability, but can be any soluble nickel salt. The concentration of nickel salt in the plating solution can range, for example, from about 0.01M to 1.0M and typically and preferably will be about 0.1M.

The reducing agent most typically will be a hypophosphite, particularly sodium hypophosphite, but also can be any other suitable reducing agent such as dimethylamine borane. For reducing agents such as sodium hypophosphite, the concentration thereof in the solution generally will be from about two to three times above the stoichiometric equivalent of nickel, preferably about 2.5 to 3.0 times above such equivalent.

Among the suitable complexing agents for metal ions, generally present in the solution in slight stoichiometric excess above the nickel ion concentration, are hydroxy acids such as hydroxyacetic acid, lactic acid, tartaric acid, citric acid, maleic acid and gluconic acid, amino acids such as glycine or alanine, ethylenediamine tetraacetic acid and pyrophosphates (particularly for a pH greater than 7.0).

The operating pH of the bath generally may range from about 4 to about 12, achieved or maintained by suitable acids or bases, particularly alkali metal hydroxides or ammonium hydroxide for baths which as formulated from all other components are too acidic. Buffers such as acetic acid, propionic acid, succinic acid or pyrophosphates can be used to prevent rapid pH changes and generally will be present at about the stoichiometric equivalent of nickel in the solution.

In each of the above classes of materials, combinations of one or more of the recited ingredients of course can be employed. In addition, some of the components can perform more than one function. For example, with the exception of the hydroxy acids, most of the complexing agents have pK values about 4.5 and thus can serve as buffering agents.

In addition to the foregoing ingredients, and the acetylenic compounds hereinafter discussed, the plating bath also may contain materials known to the art for use in electroless nickel plating. For example, metal brighteners also can be present such as lead, cadmium, bismuth, antimony or molybdenum, as well as stabilizers such as divalent sulfur compounds. Surface active agents (also known as surfactants, wetting agents or non-pitters) also may be present to prevent "pitting". In the plating reaction, gaseous hydrogen is evolved continuously in the form of small bubbles. Minute imperfections such as inclusions or pores in the surface may cause a gas bubble to adhere for a period of time instead of breaking free immediately. The presence of adhering bubbles on the surface being coated will cause localized interruptions in depositing, sometimes for many minutes, resulting in visible pits in the coating which mar the appearance of a decorative plate or become nuclei for corrosion in engineering applications. The addition of surfactants to the bath, in the range generally of from about 10 to 100 ppm, lowers the surface tension of the solution and causes the gas bubbles to be discharged immediately. The surfactants which may be employed are selected from any of those surfactants known to the art for electroless deposition, as exemplified by alkyl or aryl sulfonates, fluorocarbon surfactants such as FC-98 sold by the Minnesota Mining and Manufacturing Company, and the like.

The acetylenic compounds useful in the present invention to provide bright nickel deposits without appreciable decrease in the rate of deposition are those substantially water-soluble acetylenic compounds which contain the characteristic —C≡C— grouping. These compounds typically will contain at least one water solubilizing moiety in the molecule, such as a hydroxy, hydroxymethyl, hydroxyethyl, hydroxypropyl, methoxy, ethoxy, carboxy, hydroxyethoxy or sulfonate moiety.

The preferred acetylenic compounds correspond to the formula $$R_1—C≡C—R_2$$

wherein at least one of $R_1$ and $R_2$ is a solubilizing moiety or radical as above described and wherein the remaining $R_1$ or $R_2$ substituent is either also a solubilizing group (which can be the same or a different solubilizing group as the other $R_1$ or $R_2$ substituent) or a radical which is not per se a solubilizing group but which does not destroy the soluble characteristics of the compound.

Exemplary of these latter radicals or groups are hydrogen, halogen, diethylaminoethyl, morpholinomethyl, alkyl, alkenyl, alkynyl and cyano.

Specifically preferred among the useful acetylenic compounds are butynediol, propargyl alcohol, ethoxylated propargyl alcohol, propoxylated propargyl alcohol, methyl butynol ethylene oxide and ethoxylated butynediol.

The concentration at which the acetylenic compound is present in the plating bath is that amount effective to produce bright, preferably lustrous, mirror-like nickel coatings on substrate surfaces under electroless depositing conditions without substantially adversely affecting the operating characteristics of the bath, and specifically without substantially decreasing the electroless depositing rate of the solution. Generally, anywhere from about 10 ppm to about 1000 ppm of the acetylenic compound (or total mixture of acetylenic compounds) will produce increased specularity of the resultant nickel coating. Surprisingly, at these additive levels, there is no substantial deleterious effect on bath operating characteristics and specifically, the deposition rate will either be comparable to, or only slightly decreased from, that obtained using a bath without the acetylenic compound. More preferred levels will be in the range of from above about 50 ppm up to about 1000 ppm and from about 100 ppm to about 500 ppm.

An additional benefit realized with use of the acetylenic compounds of the invention is that they contribute surfactant and/or defoaming properties to the bath. Thus, for example, when the acetylenic compound is present in the bath and no other surfactant per se is present, it will be found that the bath generally operates in a non-pitting manner and exhibits improved characteristics in this regard as compared to the same bath without the acetylenic compound. Moreover, the acetylenic compound is very low foaming in comparison to other conventional materials used as surfactants per se. On the other hand, if a surfactant material is present in the bath and the surfactant material is one which generally encourages undesired foaming, it will be found that the acetylenic compound, at the levels used to improve specularity according to the invention, also acts to control foaming or as a defoaming agent.

The most preferred acetylenic compounds for use in this invention are the ethoxylated and propoxylated derivatives, particularly ethoxylated butynediol. As earlier noted, the general range of concentration of the acetylenic compound is from about 10 to 1000 ppm, with the lower limit established according to that level which will result in improved specularity in the nickel coating relative to a coating electrolessly deposited from a bath not containing the acetylenic compound. The practical upper limit is that level at which the plating or depositing rate becomes impractically slow as compared to a bath without the acetylenic derivative. Increased levels of acetylenic compound within the useable range result in correspondingly improved specularity of the nickel deposit. A preferred range of concentration, associated particularly with the preferred ethoxylated butynediol, is from about 30 to about 300 ppm, and most preferably from above about 50 ppm to about 300 ppm.

For most applications, the substrate or substrate surface to be coated is a conductive material, generally steel, copper or brass. Buffed brass substrates are particularly preferred for obtaining nickel deposits of a very high degree of mirror-bright specularity. For electroless deposition on metallic substrates, the bath generally will be operated at a temperature of from about 160° F. to about 200° F. The pH of the plating bath can range anywhere from about 4 to about 12, although acid baths are preferred.

The method and composition of the invention also may be employed for electroless deposition on nonconductive substrates such as glass, ceramics or plastics. For the latter, a somewhat lower plating temperature, e.g., about 150° F. or less, will be employed while a higher preferred pH, on the order of from 7 to 9, is maintained to compensate for decreased depositing rate brought about by the lower operating temperature. The non-metallic substrates are cleaned, etched and activated in accordance with conventional methods in order to render them receptive and catalytic to initial nickel coating.

Although reference is made herein to electroless plating, it will be apparent to those skilled in this art that the broad terminology includes within its scope those plating processes wherein an electrolytic or galvanic initiation of plating is employed, after which the electroless depositing commences. This manner of operation is used, for example, with metallic substrates such as brass or other copper alloys which are not per se catalytic to electroless nickel plating.

The invention is further described with reference to the following examples. In these examples the plating bath is not replenished during use, but it will be apparent that replenishment of consumed ingredients will generally be practiced in any commercial plating operation. The consumable ingredients are the nickel compound, the reducing agent (e.g., hypophosphite) and any hydroxide ion. Metallic brighteners (if employed) and any stabilizers generally are co-deposited or absorbed at very low rates. Complexing agents and buffers are not per se consumable, but may be lost by drag-out.

EXAMPLE 1

In this and the following examples, buffed brass panels were employed as the substrate. Plating is initiated galvanically after immersion in the electroless nickel plating bath by touching the panel with an actively-plating nickel strip after which deposition continued autocatalytically.

A "control" solution was prepared from the following ingredients:

| | |
|---|---|
| Nickel sulfate | 0.114 M |
| Hydroxyacetic acid | 0.5 M |
| Sodium acetate | 0.116 M |
| Sodium hypophosphite | 0.33 M |
| Water | to 1000 mls |
| Ammonium hydroxide | to pH 4.8 |

A 3 inch×4 inch brass panel, buffed on one side, was soak-cleaned and electro-cleaned in a commercial metal cleaning solution known as Dyclene EW (sold by MacDermid, Inc., Waterbury, Conn.) and rinsed with water. The panel was then immersed in the control solution (185° F.), the panel contacted with an actively-plating nickel strip for 5 seconds, and electrolessly plated for thirty minutes. The deposit formed on the panel was a dull gray and the plating rate was 0.62 grams (weight of deposit after thirty minutes, as determined by weighing the panel before and after plating).

EXAMPLE 2

The control solution of Example 1 was changed by adding thereto 100 ppm propargyl alcohol and a buffed brass panel pretreated as in Example 1 was then plated with this solution according to the same conditions. The nickel deposit was bright and uniform, with a slight haze. The plating rate was 0.45 grams.

EXAMPLE 3

To the control solution of Example 1 was added 200 ppm butynediol. A buffed brass panel pretreated as in Example 1 was then plated using this solution according to the same conditions in Example 1. The deposit was bright and uniform with a slight haze, and the plating rate was 0.40 grams.

EXAMPLES 4–7

The control solution of Example 1 was changed by adding the most preferred acetylenic compounds set forth below, at the levels shown. Substrate pretreatment and plating were as in Example 1.

| Example | Compound | Amount | Plating Rate (gms) |
|---|---|---|---|
| 4 | Ethoxylated propargyl alcohol | 200 ppm | 0.43 |
| 5 | Propoxylated propargyl alcohol | 10 ppm | 0.37 |
| 6 | Methyl butynol ethylene oxide | 1000 ppm | 0.43 |
| 7 | Ethoxylated butynediol | 100 ppm | 0.42 |

In all cases, the deposit was fully specular and mirror-like without any trace of haze.

EXAMPLE 8

To the control solution, 2 ppm lead as lead acetate were added as taught by the prior art to obtain bright nickel deposits. Using the substrate, pretreatment and plating conditions of Example 1, a plated panel was obtained which was very bright, uniform and mirror-like but which had a very slight haze visible under dark-field inspection. The plating rate was 0.67 grams.

EXAMPLE 9

In this example according to the invention, 100 ppm of ethoxylated butynediol were added to the solution of Example 8. With the same substrate, pretreatment and plating conditions as in Example 8, there was deposited a fully specular deposit with no trace of haze visible under dark-field inspection. The plating rate was 0.61 grams.

EXAMPLES 10–14

There is a relationship between the concentration of the acetylenic additive and the deposition rate, but it is rather small over an extremely wide concentration range. To the control solution of Example 1 were added the various levels shown below of ethoxylated butynediol. Panels, pretreatment and plating conditions were as in Example 1.

| Example | Concentration | Specobrity | Plating Rate (gms) |
|---|---|---|---|
| 10 | 10 ppm | Slight brightening | 0.52 |

-continued

| Example | Concentration | Specobrity | Plating Rate (gms) |
|---|---|---|---|
| 11 | 30 ppm | Brighter than Example 10 | 0.45 |
| 12 | 100 ppm | Mirror-like, no haze | 0.41 |
| 13 | 300 ppm | Mirror-like, no haze | 0.38 |
| 14 | 1000 ppm | Mirror-like, no haze | 0.36 |

EXAMPLE 15

A commercially available dimethylamine borane reduced nickel bath (Nibortek 2002—MacDermid, Inc., Waterbury, Conn.) containing FC-98 surfactant was used to plate brass panels of a size, and pretreated, as in Example 1. The bath temperature was 150° F. (pH 7) and there was no need for galvanic initiation since the panels are autocatalytic to this bath. After thirty minutes of deposition, the panel showed fairly bright and uniform nickel coverage with some cloudiness in the area of the agitation vortex. The plating rate was 0.51 grams. There was a high, stable foam blanket on the surface of the plating bath.

EXAMPLE 16

All operating aspects of Example 15 were the same except that 30 ppm of ethoxylated butynediol were added to the bath before use. The nickel-plated panels were slightly brighter than in Example 15, but the cloudiness persisted. Plating rate was 0.47 grams and less foam appeared on the bath surface than in the bath of Example 15.

EXAMPLE 17

All operating aspects of Example 15 were the same except that 100 ppm of ethoxylated butynediol were added to the bath before use. The plated panel was mirror-bright and uniform with no cloudiness. The plating rate was 0.44 grams and no foam was seen on the surface of the bath.

Although the present invention has been described at places herein in detailed respects and with reference to specific examples and materials or conditions, it will be apparent to those skilled in this art that these details are merely illustrative of the wide ranges of applicability of the invention. Modifications to these detailed features obviously can be made without departing from the scope and spirit of the invention as defined in the appended claims.

What is claimed is:

1. In a method for depositing a metal coating consisting essentially of nickel on the surface or surfaces of a substrate, comprising immersing said substrate in an aqueous solution comprising as ingredients a source of nickel ions, a soluble reducing agent for the nickel, a metal complexing agent and pH adjusting agents under conditions effective to bring about electroless deposition of nickel on said surface or surfaces by means of chemical reduction; the improvement comprising including a soluble acetylenic compound as an ingredient in said solution in an amount effective to improve the brightness of said nickel coating, the particular ingredients of said solution and their concentrations therein being such as to provide said bright nickel coating without substantially decreasing the electrodes depositing rate of the solution, as compared to the depositing rate obtained with a corresponding solution not containing acetylenic compound, said effective amount of said acetylenic compound being in excess of about 100 ppm when said acetylenic compound is butynediol.

2. The method according to claim 1 wherein said soluble acetylenic compound corresponds to the formula $$R_1—C≡C—R_2$$

wherein at least one of $R_1$ and $R_2$ is a solubilizing group and the other substituent, if not a solubilizing group, is selected from the group consisting of hydrogen, halogen, diethylaminoethyl, morpholinomethyl, alkyl, alkenyl, alkynyl and cyano radicals.

3. The method according to claim 2 wherein said solubilizing group is selected from the group consisting of hydroxy, hydroxymethyl, hydroxyethyl, hydroxypropyl, methoxy, carboxy, hydroxyethoxy and sulfonate.

4. The method according to claim 1 wherein said acetylenic compound is selected from the group consisting of ethyoxylated acetylenic compounds, propoxylated acetylenic compounds and mixtures thereof.

5. The method according to claim 4 wherein said acetylenic compound is ethoxylated butynediol.

6. The method according to claim 1 wherein the acetylenic compound, except in the case of butynediol, is present at a solution concentration in the range of from about 10 ppm to about 1000 ppm.

7. The method according to either of claims 1 or 5 wherein the acetylenic compound, except in the case of butynediol, is present at a solution concentration in the range of from about 30 ppm to about 300 ppm.

8. The method according to either of claims 1 or 5 wherein the acetylenic compound, except in the case of butynediol, is present at a solution concentration in the range of from about 50 ppm to about 300 ppm.

9. The method according to claim 1 wherein said solution further comprises a soluble source of metallic brightener.

10. The method according to claim 9 wherein said metallic brightener is selected from the group consisting of lead, cadmium, bismuth, antimony, molybdenum and mixtures thereof.

11. The method according to claim 1 wherein said solution further comprises a surface active agent.

12. The method according to either of claims 1, 5 or 6 wherein said reducing agent is selected from the group consisting of an alkali metal hypophosphite and dimethylamine borane.

13. The method according to claim 1 wherein said substrate is composed of conductive metallic material.

14. The method according to claim 1 wherein said substrate is composed of nonconductive material.

15. In an aqueous electroless nickel plating solution consisting essentially of a source of nickel ions, a soluble reducing agent for nickel, a metal complexing agent and pH adjusting agents; the improvement comprising an effective amount of a soluble acetylenic compound in said solution as an ingredient to improve the brightness of the nickel coating, the particular ingredients of said solution and their concentrations therein being such as to provide said bright nickel coating without substantially decreasing the electroless depositing rate of the solution, as compared to the depositing rate obtained with a corresponding composition not containing acetylenic compound, said effective amount of said acetylenic compound being in excess of about 100 ppm when said acetylenic compound is butynediol.

16. The composition according to claim 15 wherein said soluble acetylenic compound corresponds to the formula $$R_1—C≡C—R_2$$

wherein at least one of $R_1$ and $R_2$ is a solubilizing group and the other substituent, if not a solubilizing group, is selected from the group consisting of hydrogen, halogen, diethylaminoethyl, morpholinomethyl, alkyl, alkenyl, alkynyl and cyano radicals.

17. The composition according to claim 16 wherein said solubilizing group is selected from the group consisting of hydroxy, hydroxymethyl, hydroxyethyl, hydroxypropyl, methoxy, carboxy, hydroxyethoxy and sulfonate.

18. The composition according to claim 15 wherein said acetylenic compound is selected from the group consisting of ethoxylated acetylenic compounds, propoxylated acetylenic compounds and mixtures thereof.

19. The composition according to claim 18 wherein said acetylenic compound is ethoxylated butynediol.

20. The composition according to claim 15 wherein the acetylenic compound, except in the case of butynediol, is present at a solution concentration in the range of from about 10 ppm to about 1000 ppm.

21. The composition according to either of claims 15 or 19 wherein the acetylenic compound, except in the case of butynediol, is present at a solution concentration in the range of from about 30 ppm to about 300 ppm.

22. The composition according to either of claims 15 or 19 wherein the acetylenic compound, except in the case of butynediol, is present at a solution concentration in the range of from about 50 ppm to about 300 ppm.

23. The composition according to claim 15 wherein said solution further comprises a soluble source of metallic brightener.

24. The composition according to claim 23 wherein said metallic brightener is selected from the group consisting of lead, cadmium, bismuth, antimony, molybdenum and mixtures thereof.

25. The composition according to claim 15 wherein said solution further comprises a surface active agent.

26. The composition according to either of claims 15, 19 or 20 wherein said reducing agent is selected from the group consisting of an alkali metal hypophosphite and dimethylamine borane.

27. The composition according to claim 15 wherein said complexing agent is present in stoichiometric excess over the level of nickel in said composition.

28. A substrate having a bright nickel electroless coating thereon produced by the method of claim 1.

29. The substrate according to claim 28 wherein said substrate is composed of conductive metallic material.

* * * * *

UNITED STATES PATENT AND TRADEMARK OFFICE

CERTIFICATE OF CORRECTION

PATENT NO. : 4,600,609

DATED : July 15, 1986

INVENTOR(S) : Harold Leever and Leo J. Slominski

It is certified that error appears in the above-identified patent and that said Letters Patent are hereby corrected as shown below:

Column 1, line 25, change "or" to --of--

Column 1, line 33, change "aand" to --and--

Column 3, line 27, after "Finally" insert --a--

In the table bridging Columns 7 and 8, change "Specobrity" to --Specularity--

Column 8, line 66, change "electrodes" to --electroless--

Signed and Sealed this

Twenty-eighth Day of October, 1986

[SEAL]

*Attest:*

DONALD J. QUIGG

*Attesting Officer*

*Commissioner of Patents and Trademarks*